US009870861B2

(12) United States Patent
Zhu et al.

(10) Patent No.: US 9,870,861 B2
(45) Date of Patent: Jan. 16, 2018

(54) MULTIPLE STEP SHIFTED-MAGNETIZING METHOD TO IMPROVE PERFORMANCE OF MULTI-POLE ARRAY MAGNET

(71) Applicant: Apple Inc., Cupertino, CA (US)

(72) Inventors: Hao Zhu, San Jose, CA (US); Sean S. Corbin, San Jose, CA (US); Amy Qian, San Jose, CA (US); Richard D. Kosoglow, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 281 days.

(21) Appl. No.: 14/860,448

(22) Filed: Sep. 21, 2015

(65) Prior Publication Data

US 2017/0084389 A1 Mar. 23, 2017

(51) Int. Cl.
*H01F 41/02* (2006.01)
*H01F 13/00* (2006.01)

(52) U.S. Cl.
CPC ..... *H01F 41/02* (2013.01); *H01F 13/003* (2013.01)

(58) Field of Classification Search
CPC ..... H01F 41/02; H01F 13/003
See application file for complete search history.

(56) References Cited

U.S. PATENT DOCUMENTS

| | | | | |
|---|---|---|---|---|
| 4,614,929 | A * | 9/1986 | Tsukuda | H01F 13/003 335/284 |
| 5,200,729 | A * | 4/1993 | Soeda | H01F 7/021 335/284 |
| 5,557,248 | A * | 9/1996 | Prochazka | H01F 13/003 335/284 |
| 5,682,670 | A | 11/1997 | Bell et al. | |
| 6,154,352 | A * | 11/2000 | Atallah | H01F 13/003 361/143 |
| 6,819,023 | B1 * | 11/2004 | MacLeod | H02K 15/03 310/156.43 |
| 7,884,690 | B2 | 2/2011 | Chiu et al. | |
| 9,691,533 | B2 * | 6/2017 | Okada | H01F 7/021 |
| 2011/0148405 | A1 * | 6/2011 | Kato | G01N 27/82 324/239 |
| 2015/0091680 | A1 | 4/2015 | Gery | |

* cited by examiner

*Primary Examiner* — Scott Bauer
(74) *Attorney, Agent, or Firm* — Downey Brand LLP

(57) ABSTRACT

An efficient magnetic assembly having magnetic regions is formed by applying a magnetic field from a magnetizer to predefined portions of a monolithic substrate corresponding to the magnetized regions. In the described embodiment, the magnetic field is of sufficient strength and is applied for a sufficient amount of time to magnetize the corresponding portions of the monolithic substrate. A distance between at least two adjacent magnetized regions corresponding to a neutral zone is determined and based upon the determination, the monolithic substrate is shifted an amount less than the distance corresponding to the neutral zone and the magnetic field is re-applied to at least the shifted portion of the monolithic substrate.

20 Claims, 6 Drawing Sheets

MULTIPLE STEP SHIFTED-MAGNETIZING METHOD TO IMPROVE PERFORMANCE OF MULTI-POLE ARRAY MAGNET

FIELD

The described embodiments relate generally to forming a magnet. In particular, the present embodiments relate to forming a multi-pole magnet from a monolithic substrate.

BACKGROUND

Some devices include a magnetic assembly having more than one magnetic polarity. This can be done in several ways. Several individual magnets with different polarities can be aligned together to form the magnetic assembly. Alternatively, an electromagnet may be used to apply a magnetic field to a substrate.

However, each method has drawbacks. For instance, aligning several magnets can be time consuming and expensive. Further, to cut the magnets made from relatively hard materials requires a high end blade (e.g., diamond blade) which erodes much of the substrate during the cutting process. Electromagnets may require a relatively high amount of voltage and current, particularly in materials having a high coercivity. This may also increase costs and create a potentially dangerous environment.

SUMMARY

In one aspect, a method for forming a magnetic assembly having a pattern of magnetic regions is described. The method is carried out by forming the pattern of magnetic regions by applying a magnetic field provided by a magnetizer to predefined portions of a substrate, determining a width of a neutral zone between at least two adjacent magnetic regions, shifting the substrate from a current position to a shifted position in accordance with a distance that is less than the width of the neutral zone, and reducing the width of the neutral zone by magnetizing at least a portion of the neutral zone corresponding to the shifted position of the substrate.

In another aspect, an apparatus for forming a magnetic assembly is described. The apparatus includes at least a processor and in communication with the processor: a magnetizer comprising at least one magnetic element configured to provide a magnetizing magnetic field, a fixture arranged to secure a substrate and shift the magnetic substrate a shift distance in accordance with instructions provided by the processor, and a magnetometer arranged to determine a size and location of at least two adjacent magnetic regions and determined a distance between the at least two adjacent magnetic regions corresponding to a neutral zone. Subsequent to a first magnetization operation carried out by the magnetizer, the magnetometer determines a width of the neutral zone and provides that information to the processor that, in turn, instructs the fixture to move the shift distance and the magnetizer to commence a second magnetization operation.

In another aspect, non-transient computer readable medium for controlling an operation of an apparatus for forming a magnetic assembly, the apparatus including a processor and in communication with the processor, a magnetizer, a movable fixture for securing a magnetic substrate, and a magnetometer is described. The non-transient computer readable medium includes computer code for forming a magnetized substrate by causing the magnetizer to carry out a first magnetization operation on the magnetic substrate, computer code for causing the magnetometer to measure a width of a neutral zone between at least two adjacent regions of the magnetic substrate magnetized during the first magnetization operation, computer code for causing the movable fixture to shift the magnetized substrate an amount commensurate with the measured width of the neutral zone, and computer code for causing the magnetizer to carry out a second magnetization operation on the shifted magnetized substrate.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
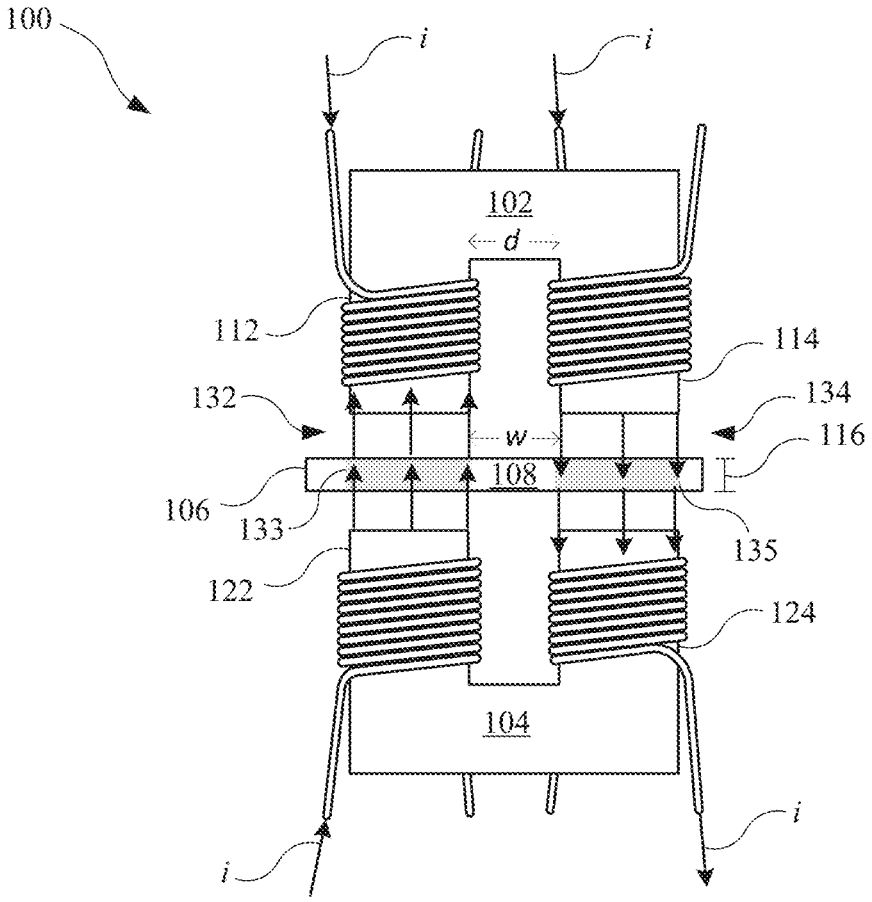
FIG. 1 illustrates a plan view of magnetizer used for implementing the described embodiments.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

This paper describes improvements in magnet processing, specifically the ability to create a multi-pole magnet that is both more compact and more cost effective than an array of separate magnets. The following disclosure relates to forming a magnetic array using a monolithic substrate. The monolithic substrate may be a single piece of metal having magnetic field lines in a first direction and magnetic field lines in a second direction opposite the first direction. For example, the monolithic substrate includes an orientation of a north-seeking pole, or "north" pole, and a south-seeking pole, or "south" pole, to define a magnetic field in a first direction. The monolithic substrate also includes another orientation of a north pole and a south to define a magnetic field in a second (opposite) direction. It should be noted that the term "coercivity" refers to a measure of the ability of a ferromagnetic material to withstand or resist becoming demagnetized by an external magnetic field. Coercivity may also be associated with the intensity of an external magnetic field required to reduce the magnetization of a material to zero. For instance, a material with a relatively low coercivity requires a relatively low external magnetic field to reduce the magnetic field to zero. Further, once the magnetic field of a monolithic substrate is reduced to zero, the external magnetic field may reverse the magnetic field of the monolithic substrate such that the monolithic substrate including a region initially having a magnetic field in a first direction to now including a magnetic field in a second direction.

This concept is especially relevant for small multi-pole magnets, which are difficult to manufacture by standard methods. Arrays of magnets are very common and very useful for maximizing field strength and attraction force in mechanisms. Moreover, magnetic arrays are very crucial to achieve some unique functions, such as magnetic alignment. The simple, but expensive and time-consuming way to make a magnetic array is based upon assembling the magnetic array from separately fabricated magnets. However, as the magnetic array size gets smaller, the costs of assembly commensurably increase. Moreover, the individual and accumulative size tolerance of each magnet will be problematic to ensure the tight tolerance of the assembled magnetic array. It would be advantageous to be able to fabricate the magnetic array as a single block or bar (also referred to as a monolithic substrate) and then magnetize the monolithic substrate into separate and well-defined polarity zones. Material such as NeFeB is well known in the art and is generally used to magnetize the magnetic substrate into a magnetic array having a number of separate and distinct magnetized zones. There are methods known in the industry for magnetizing a single block of hard magnetic material such as NeFeB into separate zones to create an equivalent part. For example, a multipolar coil can be used to magnetize the specific regions into magnetized zones having a desired polarity and level of magnetization.

However, due to the size of wire and distance between the magnet and magnetizing fixture, shadow regions are created where material is difficult to access and are therefore hard to be magnetized. These shadow regions are generally referred to as a neutral zone. Of course, as the size of the individual magnetic regions gets smaller, the relative size of the neutral zone becomes larger having an adverse impact on the overall performance of the magnetic array.

However, instead of using a single step magnetizing process to magnetize the magnetic substrate, the embodiments described herein relate a multi-step magnetizing process. Generally speaking the described embodiments relate to using a multi-step magnetizing method and apparatus to form a magnetic array using a monolithic magnetic substrate. In one embodiment, a magnetic substrate in an initial state (the initial state can be a non-magnetized state corresponding to a unmagnetized magnetic substrate that has not previously been magnetized or a substrate having an underlying magnetic state). In accordance with a first magnetizing step, a magnetizing element is used. The magnetizing element generally includes a magnetizing coil used to form a magnetizing magnetic field. The magnetizing coil can be formed of wires used to conduct electrical current. The wires having a finite size and geometry limit the ability of the magnetizing magnetic field to access certain portions of the magnetic substrate thereby creating the aforementioned neutral zone between each magnetic region. Once the first magnetizing step has been completed and a first set of magnetic regions imprinted onto the magnetic substrate, the magnetic substrate is shifted by an offset value. The offset value can be based upon many factors. One such factor is the width of the neutral zone. Once the magnetic substrate has been shifted by the offset value, a second magnetizing step is performed. The second magnetizing step has the effect of extending the magnetized regions into the neutral zone. The extension in the neutral zone reduces the overall size of the neutral zones and increases an amount of active magnetic material thereby improving both the size and strength of the magnetic array.

These and other embodiments are discussed below with reference to FIGS. 1-12. However, those skilled in the art will readily appreciate that the detailed description given herein with respect to these Figures is for explanatory purposes only and should not be construed as limiting.

FIG. 1 illustrates a plan view of magnetizer 100 used for implementing the described embodiments. Accordingly, magnetizer 100 can include first electromagnet 102 and second electromagnet 104 used to form magnetic regions in substrate 106 forming in the process a magnetic array. It should be noted, however, that in some cases, only a single electromagnet could be used such that substrate 106 can be magnetized depending, of course, on the initial condition and magnetic properties of substrate 106. However, in the context of this discussion, first electromagnet 102 and second electromagnetic 104 may combine to form an applied magnetic field in accordance with current i. As shown in FIG. 1, application of the "right hand rule" convention indicates that the magnetic field generated by magnetizer 100 will create magnetized regions in substrate 106 having alternating magnetic polarities. However, due to the physical constraints of magnetizer 100 (that include, for example, wire gauge, spacing between magnetizer prongs, etc.) a neutral zone will remain between magnetic regions. The magnetic properties of neutral zone 108 will, of course, depend upon the intrinsic magnetic properties of substrate 106. For example, if substrate 106 is initially unmagnetized magnetic material, and then the neutral zone 108 will have a level of magnetization that remains essentially the same as the initial condition of substrate 106. However, if substrate 106 has an initial condition corresponding to a level of magnetization other than neutral, the regions between the magnetized regions will retain the original level of magnetization. Therefore, generally speaking, the neutral zones NZ are more accurately described as zones that are not substantially affected by the magnetic fields generated by magnetizer 100. It is these neutral zones that reduce to overall density of the magnetic regions and reduce the overall magnetic strength of the magnetic assembly.

For example, first electromagnet 102 having first prong 112 and second prong 114 can be paired with second electromagnet 104 having third prong 122 and fourth prong 124 to generate magnetic fields having a first magnetic polarity 132 and second magnetic polarity 134, respectively.

As shown, when first electromagnet 102 and second electromagnet 104 are energized (by application of current i, for example), the resultant magnetic field generated by first prong 112 and third prong 122 induce first magnetic polarity 132 in magnetic region 133. while second prong 114 and fourth prong 124 combine to impart second magnetic polarity 134 in magnetic region 135. Neutral zone 108 separating magnetic regions 133 and 135 can be characterized as having width w that is directly related to the spacing d between prongs 132, 134 and prongs 122, 124.

Figure 2:
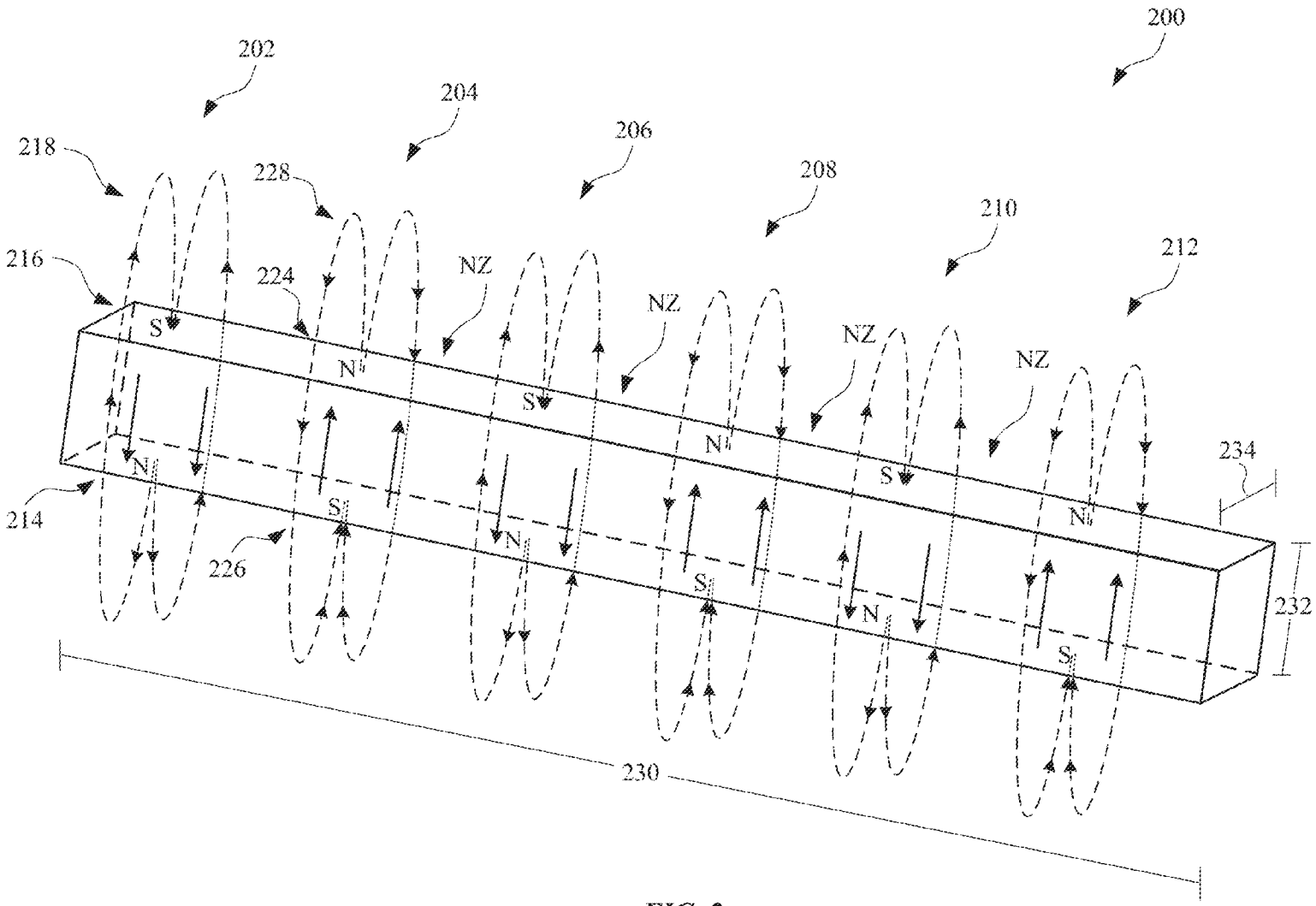
FIG. 2 illustrates an isometric view of substrate 200 having multiple portions.

FIG. 2 illustrates an isometric view of substrate 200 having multiple portions, with each portion having a dipole magnetic arrangement and associated magnetic field lines, in accordance with the described embodiments. For example, substrate 200 may include first portion 202 and second portion 204 adjacent to first portion 202. As shown, first portion 202 and second portion 204 are designed to include magnetic fields extending in opposite directions. For example, first portion 202 may include a dipole magnetic arrangement having first pole 214 (e.g., north-seeking pole, or "north" pole) and second pole 216 opposite first pole (e.g., south-seeking pole, or "south" pole) resulting in magnetic field lines in a first direction 218. Second portion 204 may also include a dipole magnetic arrangement having first pole 224 (similar to first pole 214) and second pole 226 (similar to second pole 216) opposite first pole 224. However, second portion 204 includes first pole 224 and second pole 226 are arranged to form magnetic field lines in a second direction 228 opposite first direction 218. Switching the locations or regions of first pole 224 and second pole 226 of second portion 204, as compared to first pole 214 and second pole 216, respectively, of first portion 202 may perform this.

Substrate 200 may further include third portion 206 and fourth portion 208 having substantially similar dipole magnetic arrangements as those of first portion 202 and second portion 204, respectively. Substrate 200 may include this arrangement along a lengthwise direction 230 of substrate 200 such that fifth portion 210 and sixth portion 212 are substantially similar to that of first portion 202 and second portion 204, respectively. In other embodiments, substrate 200 includes several additional portions similar to those of first portion 202 and second portion 204. Also, in some embodiments, substrate 200 is a monolithic substrate. Substrate 200 may generally be formed from any ferromagnetic material. Also, substrate 200 may include first dimension 232 and second dimension 234. Both first dimension 232 and second dimension 234 may be approximately in the range of 0.4 to 2.2 millimeters.

Figure 3:
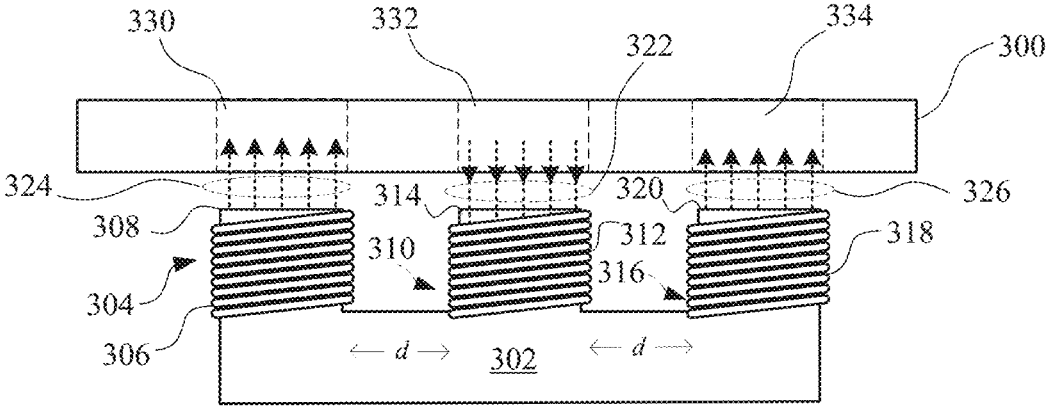
FIGS. 3-6 illustrate an apparatus that can carry out a process in accordance with the described embodiments.

FIGS. 3-6 illustrate an apparatus that can carry out a process for transforming a substrate (e.g., substrate 300) into a magnetic assembly having several dipole magnetic arrangements, in accordance with the described embodiments. FIG. 3 illustrates a plan view of substrate 300 formed from a ferrous or ferromagnetic material, in accordance with the described embodiments. As shown, substrate 300 can take the form of a monolithic substrate and for this example is magnetically neutral such that the only magnetic regions induced in substrate 300 by magnetizer 302 are present. It should be noted that magnetizer 302 can take many forms (such as shown in FIG. 1) but for simplicity and without loss of generality, magnetizer 302 can include a single sided fixture having a number of electromagnets each of which includes a core formed of ferrous material that is wrapped by a conductive wire coil that can be energized by a current to provide a magnetizing magnetic field of sufficient strength to magnetize a corresponding portion of substrate 300. Accordingly, magnetizer 302 can include electromagnet 304 formed by wrapping wire coil 306 about ferrous core 308, electromagnet 310 formed by wrapping wire coil 312 about ferrous core 314, and electromagnet 316 formed by wrapping wire coil 318 about ferrous core 320. In the described embodiment, causing a current to flow in each of the wire coils can energize each electromagnet. The strength of the magnetic field generated in such a way can depend upon the amount of current through the wire coil whereas the polarity of the magnetic field can depend upon the direction of the current (conventionally based upon the right hand rule). For this example, however, the current flowing through each of the wire coils has about the same magnitude but for at least electromagnet 310 flows in an opposite direction as the current in electromagnets 304 and 318. In this way, magnetic field 322 is provided having a polarity that is opposite that magnetic fields 324 associated with electromagnet 304 and magnetic field 326 associated with electromagnet 318.

The magnetic fields created by electromagnets 304, 310, and 316 can vary in accordance with the amount of current applied to each of the respective wire coils as well as the direction of the currents. For example, the magnetic fields can each have a magnetic field strength of approximately 30 kG (kilogauss) or as appropriate based upon the coercivity and other magnetic properties of substrate 300. It should be noted, however, that both the magnetic strength of the magnetic polarity of each magnetic field could vary from each electromagnet to the other. For example, electromagnet 304 can provide magnetic field 324 having a first strength and a first magnetic polarity whereas electromagnet 310 can provide magnetic field 322 having a second strength and a second polarity opposite the first polarity. In this way, a substrate of alternating polarity (or any polarity pattern for that matter) can be formed. It should also be noted that for various reasons, each of the electromagnets could be spaced apart. For example, due to the size of the wire that goes to form the various wire coils, the electromagnets must be spaced apart from each other by at least distance d that represents a region of reduced or null magnetic field (at least not of sufficient strength to substantially affect the magnetic properties of substrate 300).

Figure 4:
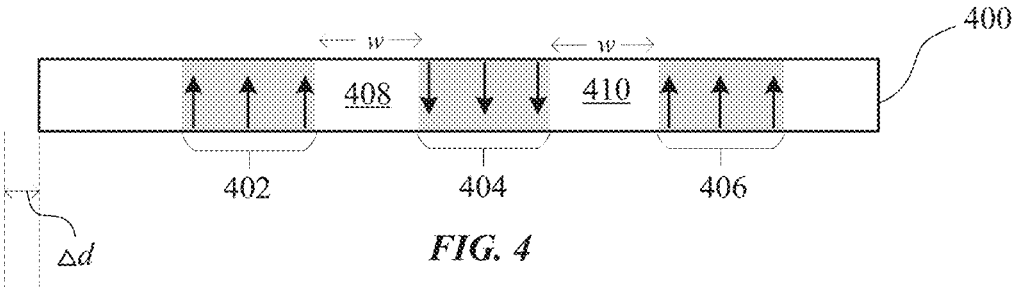

Accordingly, FIG. 4 shows the results of a first magnetization operation on substrate 300 in accordance with the described embodiments. Magnetized substrate 400 includes magnetized regions corresponding to those portions of magnetic substrate 300 exposed to a magnetic field of sufficient strength and for duration of sufficient length to realign magnetic domains with the magnetic field. For example, portion 330 of substrate 300 can be exposed to magnetic field 324 provided by electromagnet 304 for a long enough period of time that magnetic domains in portion 330 align with magnetic field 324. In this way, portion 330 of substrate 300 when magnetized as magnetic region 402 will exhibit magnetic properties akin to those of magnetic field 324. (it should be noted that for this discussion it is presumed that the magnetic regions of substrate 300 are magnetized to full saturation and thereby any additional exposure to a magnetic field of the same polarity will not further magnetize the magnetic region so exposed, however this presumption should not be construed as limiting the scope of the embodiments as any level of magnetization is possible). Likewise, portions 332 and 334 of substrate 300 can be magnetized to form magnetic regions 404 and 406, respectively, each having magnetic properties associated with the magnetic properties of magnetic fields 322 and 326.

It should be noted that due at least in part to factors associated with magnetizer 302 (such as space required to accommodate the wire cools), a magnetically neutral zone exists between each the magnetic regions. Although shown as a distinct demarcation, in reality, the transition between magnetized regions and the neutral zone is more gradual due to the lack of locality that characterizes magnetic fields in general. It should be noted that by lack of locality it is meant that magnetic fields by their nature are not generally localized. For example, even though the magnetic fields are shown as straight lines, in reality, magnetic field lines are curved having a geometry that can be greatly affected by, for example, nearby objects. In this case, fringing effects can further affect the size of the neutral zones over and above that due to structural considerations. However, for this discussion, any such effects can be ignored for simplicity. Therefore, the neutral zones shown and described are considered to be well defined but nonetheless, waste valuable substrate real estate since they do not contribute to the overall magnetic property of the magnetic substrate.

Figure 5:
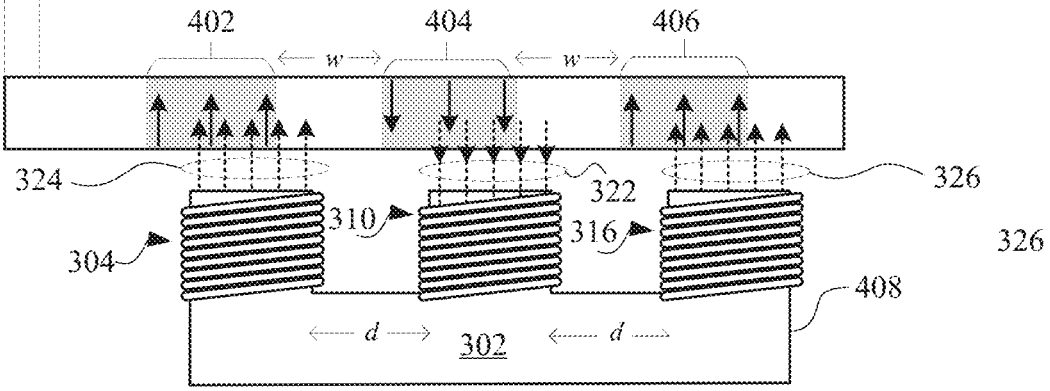
Figure 6:
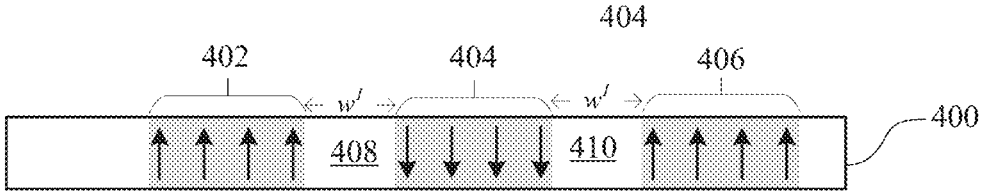

As shown in FIG. 4, magnetic substrate 400 includes magnetic regions 402 separated from magnetic region 404 by neutral zone 408 having width w and neutral zone 410 separating magnetic region 404 from magnetic region 406. In the described embodiments, width w corresponds to distance d separating electromagnets 304 and 310. Since it is impractical to structurally rebuild magnetizer 302 to reduce distance d, therefore, in order to reduce width w of neutral zones 408 and 410, magnetic substrate 400 is shifted a distance Δd corresponding to an amount of neutral zones 408 and 410 that can be magnetized by magnetizer 302 as shown in FIG. 5. Accordingly, once magnetic substrate 400 is shifted distance Δd, magnetic substrate 400 can undergo a second (or more) magnetization operation when power is supplied to magnetizer 302. This second magnetization operation magnetizes that portion magnetic substrate 400 corresponding to neutral zones 408 and 410. In this way, magnetic regions 402, 404, and 406 are enlarged at the expense of neutral zones 408 and 410. For example, prior to the second magnetization operation, neutral zones 408 and 410 have corresponding width of w whereas after the second magnetization operation, magnetic regions 402, 404, and 406 have expanded by about an amount corresponding to distance Δd and neutral zones 408 and 410 have their widths commensurably reduced (from about width w to width $w^1$). It should be noted that the magnetic fields (322, 324, 326) provided by magnetizer 302 could have different magnetic properties as compared to the first magnetization operation. In any case, as shown in FIG. 6, subsequent to the second magnetization operation, magnetic regions 402, 404, and 406 have expanded in accordance with the shifted distance 6*d* whereas the neutral zones 408 and 410 have contracted a commensurate amount. In this way, by simply shifting magnetic substrate 400, the amount of wasted substrate real estate can be reduced having the effect of improving the overall performance of magnetic substrate 400.

Figure 7:
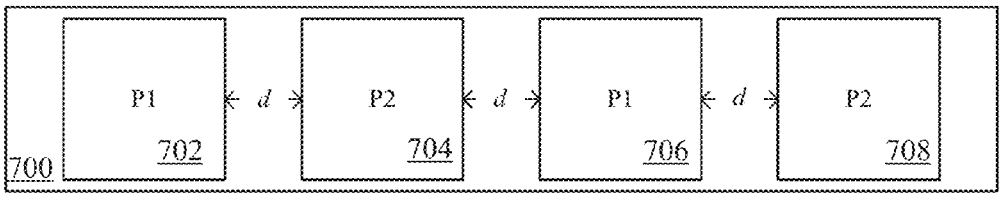
FIGS. 7-10 provides another perspective of the described embodiments.
Figure 8:
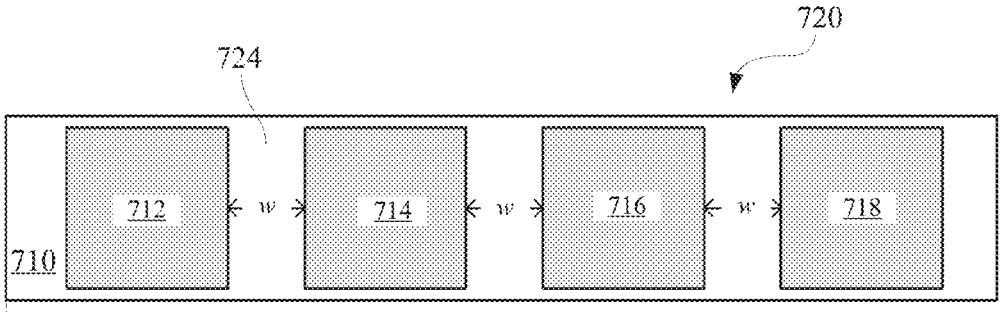
Figure 9:
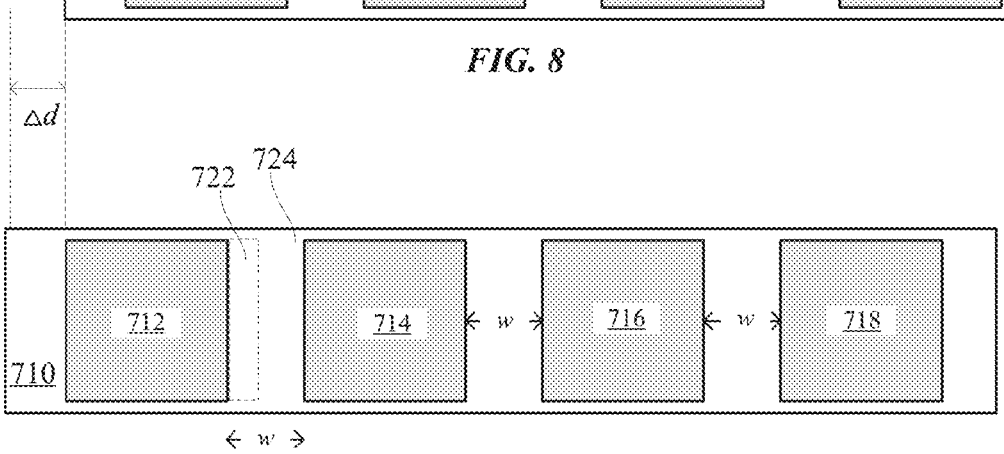
Figure 10:
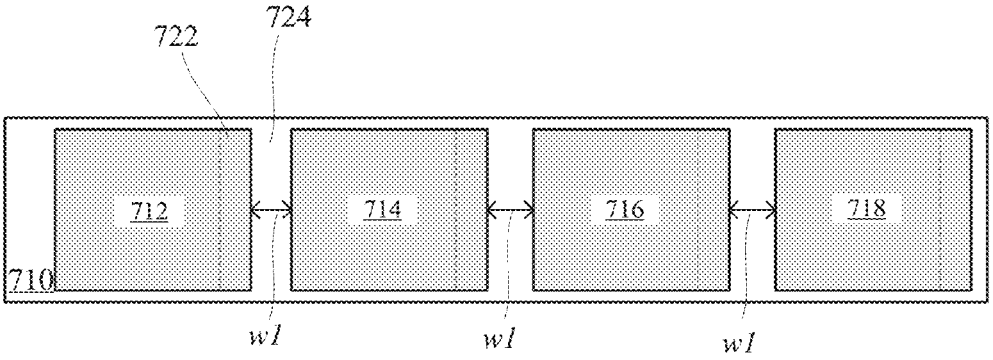

FIGS. 7-10 provides another perspective of the described embodiments. FIG. 7 shows a representation of magnetizer 700 having magnetization elements 702-708 arranged in a linear fashion having alternating polarities (represented by P1 and P2). Magnetization elements 702-708 are spaced apart distance d representing a minimum pitch that can be provided due to various factors related to, for example, structural limitations of magnetization elements and so on. FIG. 8 shows a result of a first magnetization operation used to create magnetic assembly 720. First magnetization operation I can be performed by magnetizer 700 on magnetic substrate 710 creating magnetic regions 712 to 718 having alternating magnetic polarities that taken provide the magnetic properties corresponding to magnetic assembly 720. As shown, magnetic regions 712-718 are separated from each other portions of magnetic substrate 710 that are substantially unaffected by magnetizer 700 referred to previously as neutral zones having a width w related to distance d. In this embodiment, the neutral zones represent portions of magnetic substrate 710 that have not been magnetized at least to the level of magnetization associated with magnetic regions 712-718 and as such do not substantially contribute to the overall performance of magnetic assembly 720. In order to reduce the wastage associated with the neutral zones, magnetic substrate 710 is shifted an amount corresponding to distance M. In this way, portions 722 of magnetic substrate 710 that were heretofore not sufficiently exposed to the magnetic field provided by magnetizer 700 to render them magnetically compatible with magnetic regions 712-718 are shifted to a position whereby during a second (or more) magnetization operation, at least some of magnetic substrate 710 previously associated with the neutral zones are sufficiently exposed to the magnetizing magnetic field be altered sufficiently to be considered part of the magnetic regions. For example, second magnetization operation can enlarge magnetic regions 712-718 at the expense of the neutral zones (i.e., width associated with a reduced neutral zone is less than width associated with original neutral zone). In other words, as an example, portion 722 of neutral zone 724 can be sufficiently magnetized to be considered part of magnetic region 712 as shown in FIG. 10. In this way, each of magnetic regions 712-718 are commensurably enlarged at the expense of an adjacent neutral zone. In this way, the overall utilization of magnetic substrate 710 can be increased with a concomitant improvement in the performance of magnetic assembly 720.

Figure 11:
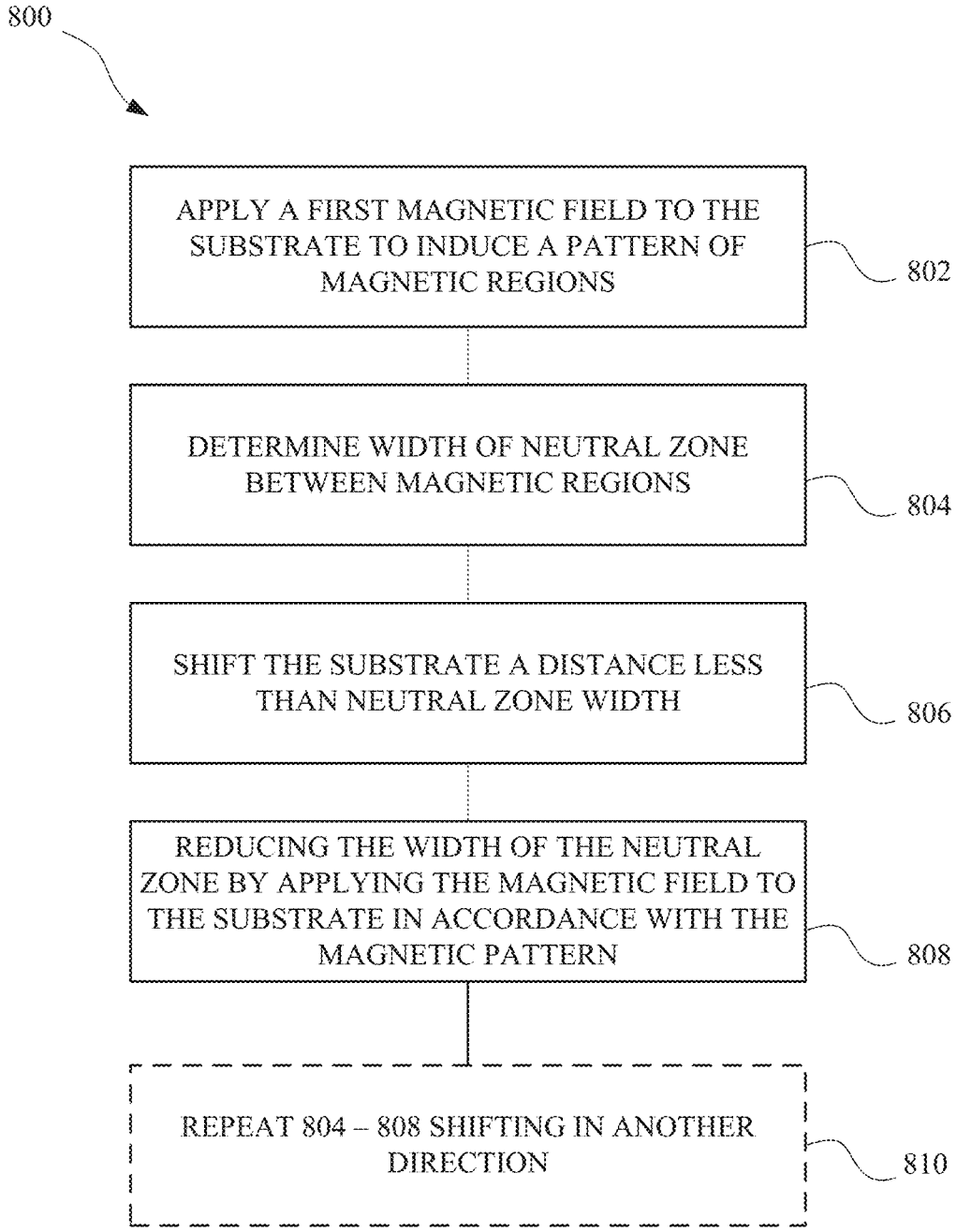
FIG. 11 illustrates a flowchart showing a method in accordance with the described embodiments.

FIG. 11 illustrates a flowchart 800 showing a method for forming a magnetic assembly in accordance with the described embodiments. In step 802, during a first magnetization operation, a first magnetic field is applied by a magnetizer to a substrate having a sufficient strength and for a sufficient length of time to induce a pattern of magnetic regions in the substrate. In one embodiment, the magnetic regions can exhibit magnetic properties that taken together correspond to the magnetic assembly. In one embodiment, the pattern can be associated with an alternating polarity pattern. In one embodiment, the pattern can be associated with different sizes of magnetic regions. In one embodiment, the pattern can be a linear pattern or a two dimensional pattern. Next at step 804, a width of a neutral zone between at least two adjacent magnetic regions is determined. The neutral zone represents that portion of the magnetic substrate that has insufficient magnetization for consideration as part of any of the magnetic regions. This can be due to structural limitations of the magnetizer, for example. At step 806, the magnetic substrate is shifted a distance. In one embodiment, the distance that the magnetic substrate is shifted can be less than the width of the neutral zone. At step 808, a second magnetization operation is carried out having the effect of increasing the size of the magnetic regions at the expense of the corresponding neutral zones. At optional step 810, steps 804-808 are performed when it is determined that additional portions of the neutral zone are to be converted in subsequent magnetization operations.

Figure 12:
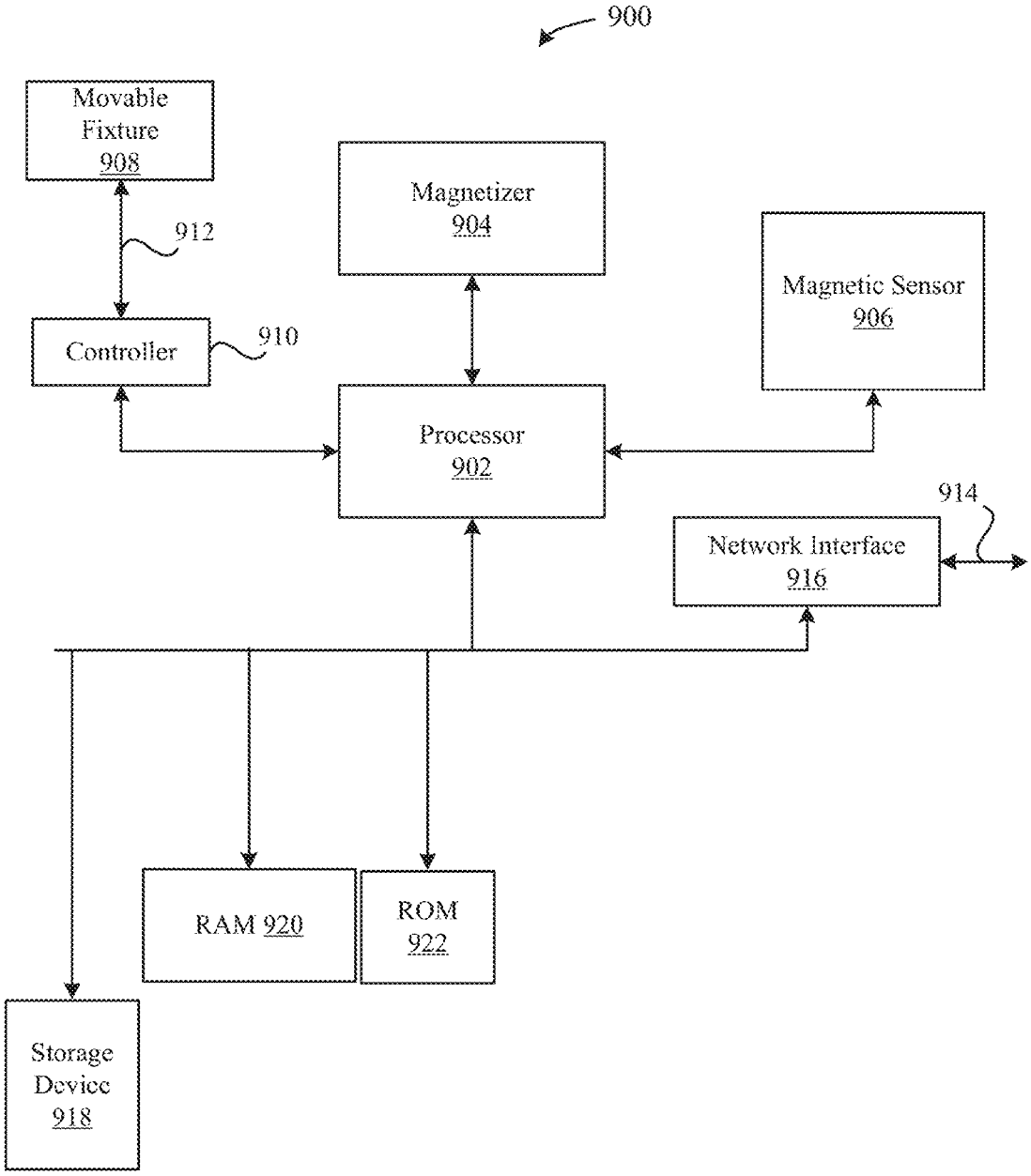
FIG. 12 shows a representative magnetization system in accordance with the described embodiments.

FIG. 12 is a block diagram of an apparatus 900 that can include a processor 902 that represents a microprocessor or controller for controlling the overall operation of apparatus 900. The apparatus 900 can also include a magnetizer 904 that provides a magnetizing magnetic field suitable for forming magnetized regions in a substrate. Magnetizer 904 can include magnetizing elements capable for providing a magnetic field suitable for magnetizing a substrate. Still further, the apparatus 900 can include a magnetic sensor 906 for detecting a magnetic field. A movable fixture 908 can secure a substrate during a magnetization operation. The movable fixture 908 can be in communication with the processor 902, and a controller 910. The controller 910 can be used to interface with and control different equipment such as the movable fixture 908 through and equipment control bus 912. The apparatus 900 can also include a network/bus interface 914 that couples to a data link 916. In the case of a wireless connection, the network/bus interface 916 can include a wireless transceiver.

The apparatus 900 also include a storage device 918, which can comprise a single disk or a plurality of disks (e.g., hard drives, SSD), and includes a storage management module that manages one or more partitions within the storage device 918. In some embodiments, storage device 918 can include flash memory, semiconductor (solid state) memory or the like. The apparatus 900 can also include a Random Access Memory (RAM) 920 and a Read-Only Memory (ROM) 922. The ROM 922 can store programs, utilities or processes to be executed in a non-volatile manner. The RAM 920 can provide volatile data storage, and stores instructions related to the components of the apparatus 900.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

In one aspect, a method for forming a magnetic assembly having magnetic regions is described. The method is carried out by initially forming the magnetic regions. The magnetic regions are formed by applying a magnetic field from a magnetizer to predefined portions of a monolithic substrate corresponding to the magnetized regions. In the described embodiment, the magnetic field is of sufficient strength and is applied for a sufficient amount of time to magnetize the corresponding portions of the monolithic substrate. A distance between at least two adjacent magnetized regions corresponding to a neutral zone is determined and based upon the determination, the monolithic substrate is shifted an amount less than the distance corresponding to the neutral zone and the magnetic field is re-applied to at least the shifted portion of the monolithic substrate.

In another aspect, an apparatus for forming a magnetic assembly is described. The apparatus includes at least a processor and in communication with the processor: a magnetizer comprising at least one magnetic element configured to provide a magnetizing magnetic field, a fixture arranged to secure a substrate and shift the magnetic substrate a shift distance in accordance with instructions provided by the processor, and a magnetometer arranged to determine a size and location of at least two adjacent magnetic regions and determined a distance between the at least two adjacent magnetic regions corresponding to a neutral zone. Subsequent to a first magnetization operation carried out by the magnetizer, the magnetometer determines a width of the neutral zone and provides that information to the processor that, in turn, instructs the fixture to move the shift distance and the magnetizer to commence a second magnetization operation.

What is claimed is:

1. A method for forming a magnetic assembly having a pattern of magnetic regions, the method comprising:

forming the pattern of magnetic regions by applying a magnetic field provided by a magnetizer to predefined portions of a substrate;

determining a width of a neutral zone between at least two adjacent magnetic regions in the pattern of magnetic regions;

shifting the substrate from a current position to a shifted position in accordance with a distance that is less than the width of the neutral zone; and reducing the width of the neutral zone by magnetizing at least a portion of the neutral zone corresponding to the shifted position of the substrate.

2. The method as recited in claim 1, wherein the shifted position is a first shifted position and the reduced width is a first reduced width.

3. The method as recited in claim 2, further comprising: shifting the substrate from the first shifted position to a second shifted position corresponding to a second reduced width that is less than the first reduced width.

4. The method as recited in claim 3, further comprising: applying the magnetic field to the substrate in the second shifted position.

5. The method as recited in claim 1, wherein the substrate is a monolithic substrate.

6. The method as recited in claim 1, further comprising: using a magnetometer to determine the width of the neutral zone.

7. The method as recited in claim 1, wherein the two adjacent magnetic regions comprise alternating magnetic polarities.

8. The method as recited in claim 1, the magnetic field being of sufficient strength and applied for a sufficient amount of time to magnetize the predefined portions of the substrate.

9. An apparatus for forming a magnetic assembly, comprising:

a processor, and in communication with the processor:

a magnetizer comprising at least one magnetic element configured to provide a magnetic field during a first magnetization operation;

a fixture arranged to secure a substrate during the first magnetization operation and shift the substrate a distance in accordance with instructions provided by the processor; and a magnetometer configured to detect magnetic fields, wherein subsequent to the first magnetization operation, the magnetometer is operable to: (i) determine a size and location of at least two adjacent magnetic regions, (ii) determine a distance between the at least two adjacent magnetic regions corresponding to a width of a neutral zone, and (iii) provide the width of the neutral zone to the processor, and wherein the processor is operable to: (a) instruct the fixture to move the substrate to another position, and (b) instruct the magnetizer to initiate a second magnetization operation.

10. The apparatus as recited in claim 9, wherein the second magnetization operation reduces the width of the neutral zone to a first reduced width.

11. The apparatus as recited in claim 10, wherein the reduction of the width of the neutral zone is due to magnetization of a portion of the neutral zone corresponding to the other position of the substrate during the second magnetization operation.

12. The apparatus as recited in claim 9, wherein the processor instructs the fixture to move the substrate to another position subsequent to the second magnetization operation.

13. The apparatus as recited in claim 12, wherein the processor instructs the magnetizer to initiate a third magnetization operation that further reduces the size of the neutral zone.

14. The apparatus as recited in claim 9, wherein the substrate is a monolithic substrate.

15. The apparatus as recited in claim 9, wherein the magnetizer generates a pulsed magnetic field.

16. A non-transient computer readable medium for controlling an operation of an apparatus for forming a magnetic assembly, the apparatus including a processor, and in communication with the processor, a magnetizer, a movable fixture for securing a magnetic substrate, and a magnetometer, comprising:

computer code for forming a magnetized substrate by causing the magnetizer to carry out a first magnetization operation on the magnetic substrate;

computer code for causing the magnetometer to measure a width of a neutral zone between at least two adjacent regions of the magnetic substrate magnetized during the first magnetization operation;

computer code for causing the movable fixture to shift the magnetic substrate by an amount commensurate with the width of the neutral zone measured by the magnetometer; and computer code for causing the magnetizer to carry out a second magnetization operation on the shifted magnetic substrate.

17. The non-transient computer readable medium as recited in claim 16, wherein the magnetic substrate is shifted to a first shifted position and the second magnetization operation reduces the width of the neutral zone to a first reduced width that is less than the width of the neutral zone measured by the magnetometer.

18. The non-transient computer readable medium as recited in claim 17, further comprising: computer code for shifting the magnetic substrate from the first shifted position to a second shifted position corresponding to a second reduced width that is less than the first reduced width.

19. The non-transient computer readable medium as recited in claim 18, further comprising: computer code for applying a magnetic field to the magnetic substrate located at the second shifted position.

20. The non-transient computer readable medium as recited in claim 16, wherein the magnetic substrate is a monolithic substrate.

* * * * *